US005240230A

United States Patent [19]

Dougherty

[11] Patent Number: 5,240,230

[45] Date of Patent: Aug. 31, 1993

[54] FENCE PANEL WITH INTEGRAL ANCHOR FITTING

[76] Inventor: Earle T. Dougherty, 3420 N. 71st Ave., Phoenix, Ariz. 85033

[21] Appl. No.: 869,461

[22] Filed: Apr. 15, 1992

[51] Int. Cl.[5] ..... E04H 17/08

[52] U.S. Cl. ..... 256/31; 256/24; 256/64; 256/65; 52/156

[58] Field of Search ..... 256/24, 25, 31, 64, 256/65, 73, 35, 47, 1, 26, DIG. 5; 52/156, 158, 159, 155; 160/135, 351

[56] References Cited

U.S. PATENT DOCUMENTS

| | | | |
|---|---|---|---|
| 160,046 | 2/1875 | Wright | 256/73 X |
| 1,044,351 | 11/1912 | Clay | 256/35 X |
| 1,130,287 | 3/1915 | Horvath | 256/24 |
| 2,392,011 | 1/1946 | Stringer | 256/64 |
| 2,517,386 | 8/1950 | Cooper | 256/25 |
| 3,767,167 | 10/1973 | Rasmussen | 256/26 |
| 3,921,960 | 11/1975 | Bright | 256/65 |
| 4,067,547 | 1/1978 | Peters | 256/25 X |
| 4,085,789 | 4/1978 | Steiner et al. | 160/135 |
| 4,371,148 | 2/1983 | Harden | 256/73 X |
| 4,682,761 | 7/1987 | Hanneken | 256/64 X |
| 5,104,074 | 4/1992 | Malloy | 52/156 X |

FOREIGN PATENT DOCUMENTS

| | | | |
|---|---|---|---|
| 1282729 | 12/1960 | France | 256/24 |
| 6705535 | 4/1967 | Netherlands | 256/24 |
| 12359 | of 1886 | United Kingdom | 256/24 |
| 945211 | 12/1963 | United Kingdom | 256/24 |
| 1020981 | 2/1966 | United Kingdom | 52/158 |
| 2067705 | 7/1981 | United Kingdom | 256/25 |

*Primary Examiner*—Randolph A. Reese
*Assistant Examiner*—Harry C. Kim
*Attorney, Agent, or Firm*—Cahill, Sutton & Thomas

[57] ABSTRACT

A self-supporting panel for a fence has a skewed anchor sleeve welded to each lower corner of the panel for receiving a stake to fasten the anchor sleeve to the ground or other support. Two panels are joined by a pin in the open ends of abutting lower rails from each panel and by a cap joining the upper ends of adjacent stiles from each panel.

18 Claims, 2 Drawing Sheets

FENCE PANEL WITH INTEGRAL ANCHOR FITTING

BACKGROUND OF THE INVENTION

1. Field of the Invention

This invention relates to prefabricated fences and, in particular, to a fitting for temporarily or permanently anchoring a panel fence to the ground or other support.

2. Description of the Prior Art

Fences have been assembled on a job site from prefabricated panels or from separate components, i.e. posts, rails, stiles, and some sort of barrier such as a wire web, or slats, or the like. For a typical chain link fence, post holes are dug and a metal post is placed in the hole. The hole is then filled with concrete while the post is kept vertical. After the concrete has had time to set, the web, usually in the form of a large roll, is installed. The web is typically unrolled along the fence and attached to the posts and to rails interconnecting the tops of the posts. Occasionally, a heavy cable or a rod is attached to the bottom of the web and attached to the lower ends of the posts, just above ground level.

Stretching and attaching the web to the rails and posts takes a great deal of time and effort. Prefabricated panels have long been used to provide an economical and more easily installed fence. U.S. Pat. No. 2,709,073 discloses a typical, prefabricated, chain link fence. Each panel consists of a rectangle made from welded pipe having a chain link web attached to it by a wire entwining both the web and the pipe. The panels, in turn, are attached to posts spaced so that the panels fit closely between the posts. The posts are typically set in concrete or in a closely fitting sleeve which is set in concrete. The panels are typically six feet high, from rail to rail, and twelve and one half feet long.

To some extent, there is duplication of parts in that the pipes from adjacent panels are attached to the post, which itself can be a pipe like that used for the panels. Thus, three pipes are adjacent to each other at each end of a panel. While extending the length of the panels reduces the number of posts, it is desirable to eliminate the posts altogether in order to reduce costs further.

Temporary fences, such as used at construction sites, outdoor public events, and the like, not only have to be easily installed but also easily removed, yet be sturdy and secure when installed. Since they are bolted together, they can be unbolted and the premises entered. In addition, the hardware used for assembly, clamps and the like, is expensive and makes assembly a time consuming, expensive project. For construction sites or hazardous areas, this type of construction is not sufficiently secure. More permanent types of installation are expensive to install and, when the fence is no longer needed or wanted, expensive to remove. Further, a used fence typically has no salvage value. For those businesses which rent fences, this is a serious problem.

SUMMARY OF THE INVENTION

A fence panel has pipes for the rails and the stiles that frame the panel and support the webbing across the panel. The ends of the upper rail are welded to the sides of the stiles, closing the upper rail. The lower ends of the stiles are welded to the side of the lower rail, leaving the ends of the lower rail open. Each lower corner of the panel includes an anchor sleeve welded to one or both of the rail and stile for receiving a pin or stake to fasten the anchor sleeve to the ground or other support.

The longitudinal axis of the anchor sleeve is skewed so that it is not in the plane of the panel. The anchor sleeves at each end of the lower rail are on opposite sides of the lower rail whereby the stakes are splayed at each juncture of two panels. Two panels are joined by a pin in the open ends of abutting lower rails and by a cap joining the upper ends of adjacent stiles.

It is an object of the invention to provide a fence panel which can be easily installed or removed yet is sturdy and secure when installed.

Another object of the invention is to simplify erection of the panels of a panel fence.

A further object of the invention is to provide angled sleeves for temporarily or permanently anchoring a fence.

Another object of the invention is to provide a self-supporting fence panel which can be re-used several times.

A further object of the invention is to provide a fitting for use in making self-supporting, non-standard sized fence panels.

Another object of the invention is to provide a fence panel which can be installed with a minimum of hardware and tools.

DESCRIPTION OF THE DRAWINGS

A more complete understanding of the invention can be obtained by considering the following detailed description in conjunction with the accompanying drawings, in which.

DETAILED DESCRIPTION OF THE PREFERRED EMBODIMENT

Figure 1:
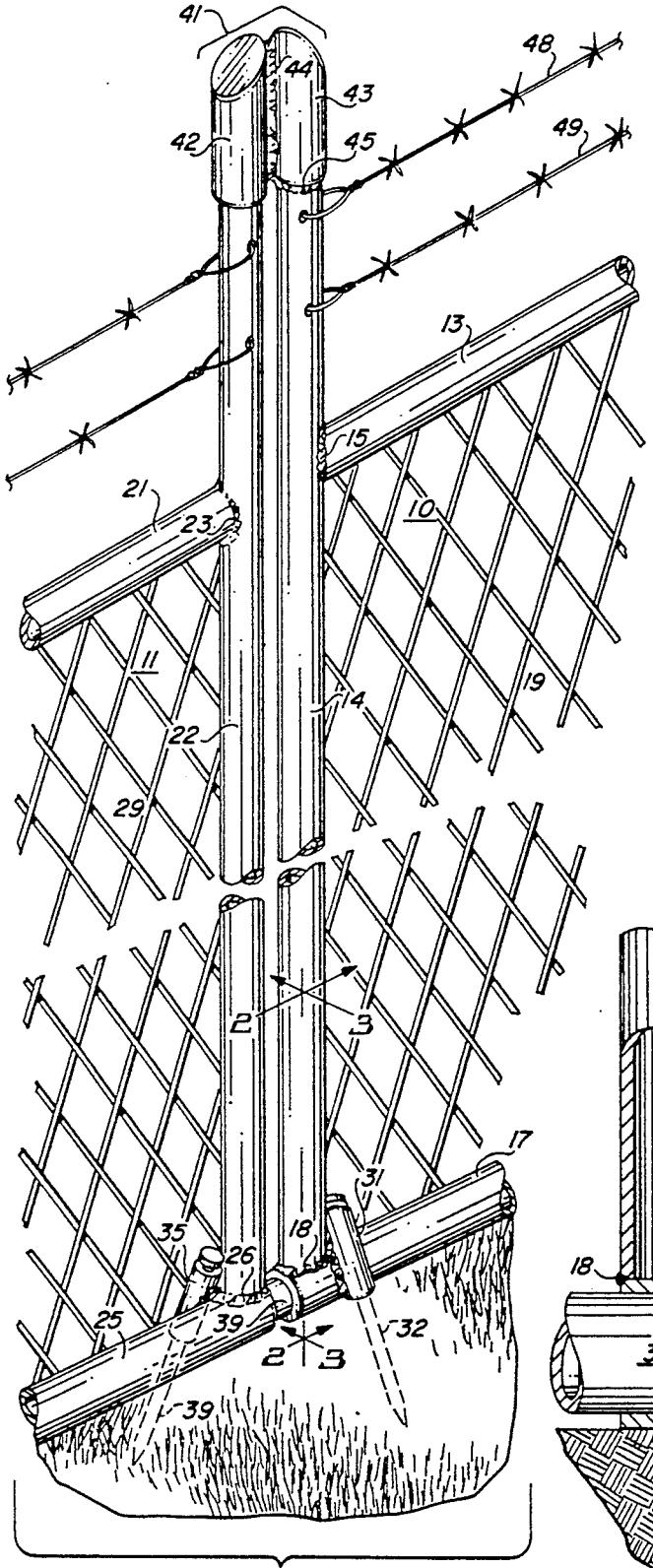
FIG. 1 illustrates the juncture of two panels in a fence constructed in accordance with a preferred embodiment of the invention.

FIG. 1 illustrates the juncture of panels 10 and 11 in a fence having a series of adjoining panels in a straight line or forming a perimeter of predetermined shape. Each panel is framed by welded pipe in the form of a pair of rails and a pair of stiles. The right hand side of panel 10 (not shown) is constructed in the same manner as the right hand side of panel 11.

In panel 10, upper rail 13 is attached to stile 14 at weld 15. The upper rail abuts on stile 14 in a T-connection located a short distance below the upper end of stile 14 to extend stile 14 above upper rail 13. The end of rail 13 is closed by stile 14. Lower rail 17, which is slightly longer than upper rail 13, is attached to the lower end of stile 14 at weld 18 and the lower end of the stile is closed by the weld and lower rail 17 (note also FIG. 3). Panel 11 is similarly constructed in that upper rail 21 abuts on stile 22 at a point below the upper end of the stile and is closed by weld 23. The lower end of stile 22 abuts on lower rail 25 and is closed by weld 26.

Figure 2:
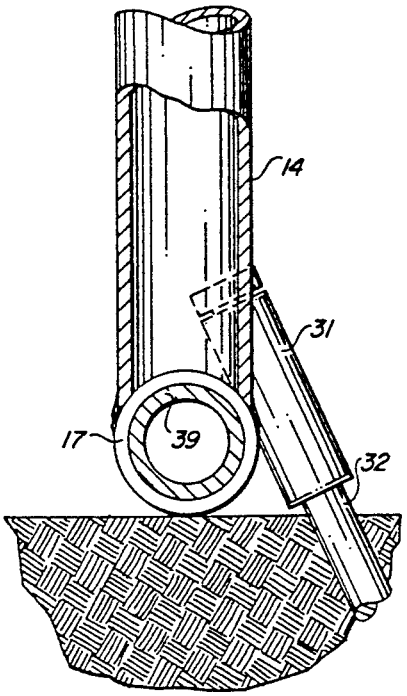
FIG. 2 is a cross-section of the fitting taken along line 2—2 in FIG. 1.
Figure 3:
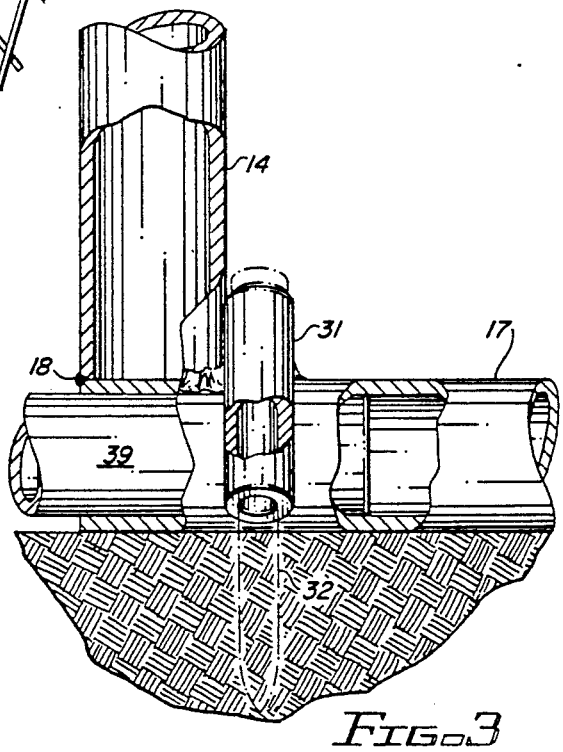
FIG. 3 is a cross-section of the fitting taken along line 3—3 in FIG. 1.

The longitudinal axes of stile 14 and rail 17 intersect and are perpendicular to each other to define orthogonal axes. Anchor sleeve 31 is welded to rail 17 or stile 14, or, preferably, to both. The axis of anchor sleeve 31 is skew to the axes of stile 14 and rail 17. By "skew" is meant that the longitudinal axis of anchor sleeve 31 is not in the plane defined by the longitudinal axes of stile 14 and rail 17 and the longitudinal axis of anchor sleeve 31 does not intersect the longitudinal axis of either stile 14 or rail 17. By slanting anchor sleeve 31 with respect to rail 17, stake 32 can be inserted through the anchor sleeve at an angle to fasten the anchor sleeve to the ground, as also shown in FIGS. 2 and 3. In addition to anchoring the left hand side of panel 10, anchor sleeve 31 strengthens the joint between stile 14 and rail 17.

The right hand side of panel 11 is constructed similarly to the left hand side of panel 10 except that anchor sleeve 35 is skewed in a different direction from anchor sleeve 31 and the sleeves are not parallel. Anchor sleeve 35 is welded to stile 22 or rail 25, or both, on the side of the lower rail opposite from anchor sleeve 31. Stake 36 passes through anchor sleeve 35 and is driven into the ground to anchor the right hand side of panel 11.

The length of the stake is not critical and depends upon the material in which the stake is being inserted. It is generally preferred to have a stake longer than approximately eighteen inches for anchoring in loose, e.g. sandy soil. For clay soils, a shorter stake can be used. For permanent installations, the stake may be set in concrete.

Because the anchor sleeves are skewed in different directions at each end of a panel, stakes 32 and 36 are splayed as they enter the ground or other support surface. This provides a secure anchor for the panels and prevents them from being lifted vertically. In addition, the stakes can not be removed from the same side of the fence, which provides a further advantage. For example, even if someone were able to remove stake 36, he would not have access to the other side of the fence in order to remove stake 32. Thus, the fence protects itself from tampering.

Web 19, which is preferably chain link, is attached to rails 13 and 17 and to stile 14 by any suitable means, not shown. Similarly, web 29 is attached to rails 21 and 25 and stile 22. Stiles 14 and 22 extend above rails 13 and 21 to permit adding barbed wires 48 and 49. If there were to be no additional wires or barrier above rails 13 and 21, then stiles 14 and 22 can be shortened, but they should remain extended above rails 13 and 21 to permit attachment of the extended portions to one another.

Figure 4:
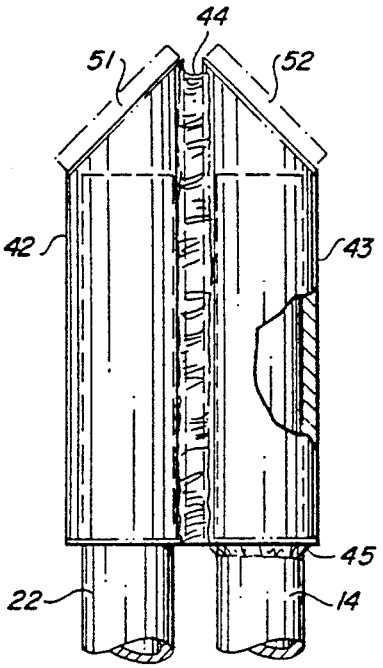
FIG. 4 illustrates a cap for use with fence panels incorporating the fitting shown in FIGS. 1–3.

The upper ends of stiles 22 and 14 are attached or connected to one another by cap 41, as illustrated in FIGS. 1 and 4. Cap 41 includes parallel sleeves 42 and 43 welded together along their length, as indicated by reference numeral 44. If desired, the upper ends of sleeves 42 and 43 can be cut at an angle or bevel and closed with plates 51 and 52. Sleeves 42 and 43 fit over the extended portions or upper ends of stiles 14 and 22. Cap 41 is permanently attached to stile 14 by weld 45. It could be attached to either stile 14 or stile 22, but only to one. This reduces the number of separate parts which must be accounted for and handled at the job site. Alternatively, cap 41 can be attached to the stiles by machine screws at the job site.

Figure 7:
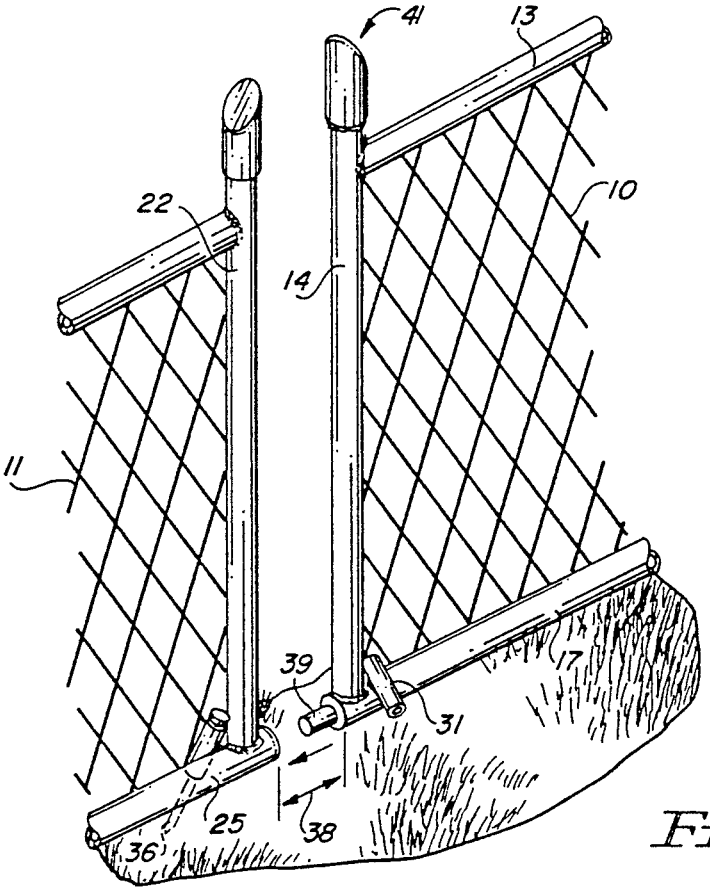
FIG. 7 illustrates the assembly of a fence constructed in accordance with the invention.

As shown in FIG. 7, lower rails 25 and 17 are interconnected by pin 39, which can be a smaller diameter pipe or a solid bar. Pin 39 is preferably welded to lower rail 17, i.e. to the same end of panel to which the cap is attached. This prevents pin 39 from being driven all the way into either lower rail, reduces the number of separate parts, and facilitates the assembly of the panels into a fence.

Figure 5:
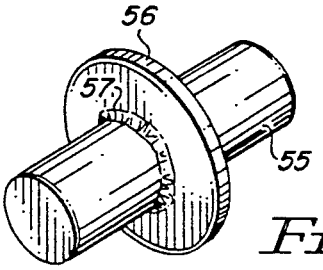
FIG. 5 illustrates a removable fitting for connecting the lower rails.

FIG. 5 illustrates a floating pin constructed in accordance with a preferred embodiment of the invention. Pin 55 is not intended to be permanently attached to either lower rail, hence it can "float" or move around within the rails. To prevent pin 55 from being driven completely into either lower rail, washer 56 is attached to pin 55 by weld 57. Pin 55 can be inserted into either lower rail only to the extent permitted by washer 56, which has an outside diameter greater than the inside diameter of the lower rails. The overall length of pin 39 or pin 55 is not critical. A length of four to six inches, with approximately half of the pin being located in each adjoining lower rail, has been found suitable. Removable pins are preferable for short term or rental types of uses where the panels will be arranged to make perimeters of different shapes.

Figure 6:
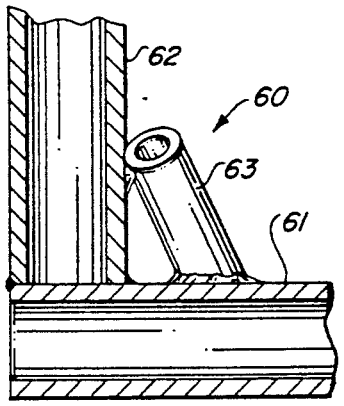
FIG. 6 is a partial cross-section of a corner fitting for making non-standard sized panels.

FIG. 6 illustrates a fitting for use with panels of nonstandard sizes to adapt the panels to the particular requirements of the installations. Fitting 60 is essentially the corner of a panel rendered in slightly larger pipe to make sleeves into which the rails and stiles can be inserted. Fitting 60 includes sleeves 61 and 62, having orthogonal longitudinal axes. Anchor sleeve 63 is skew to the axes of sleeves 61 and 62. The sleeves are preferably joined by welding. Oriented as shown in FIG. 6, fitting 60 serves as the lower left hand corner of a panel. To be used as the upper left hand corner of a panel, fitting 60 must be reoriented so that sleeve 61 is vertical. Thus, if fitting 60 were rotated clockwise ninety degrees, it could serve as the upper left hand corner of panel 10. At the upper left hand corner, rail 13 would fit within sleeve 62 and stile 14 would extend through sleeve 61 to a point above rail 13. Fitting 60 can be attached to the rails and stiles by any suitable means such as machine screws, welding, or a wedge driven between the outer surface of the rail or stile and the inside surface of sleeves.

FIG. 7 illustrates the assembly of a fence using panels constructed in accordance with the present invention. Panel 11 is already in place, anchored to the ground by stake 36, and another stake at the left hand end of the panel (not shown). Panel 10 is positioned adjacent panel 11 and cap 41, which is welded to stile 14, is lowered over stile 22. The left end of lower rail 17 is displaced longitudinally a small distance, indicated by reference number 38, for the end of pin 39 to clear the end of rail 25. Pin 39, which is welded to lower rail 17, is then inserted into lower rail 25 and a stake is driven through anchor sleeve 31 to fasten the lower left hand corner of panel 10.

If panels 10 and 11 were in a straight line and if the juncture between them were the last juncture in assembling a fence, i.e. the right hand side of panel 10 is already installed, then stake 36 is removed from sleeve 35 and the adjoining ends of rails 17 and 25 are moved sideways in the same direction, into or out of the plane of the drawing, to separate the ends for pin 39 to clear the end of rail 25. Pin 39 is inserted into lower rail 25 and the ends of rails 17 and 25 are moved back into alignment along a straight line. Stake 36 is again driven into the ground through sleeve 35 and a stake is driven into the ground through sleeve 31, completing the assembly of the fence.

Adjacent panels can define a corner by bending pin 39; the cap can accommodate any corner angle since only one of the sleeves is permanently attached to a stile. More than two panels can meet at an intersection by simply providing additional fingers on pin 39 for engaging the lower rails of the additional panels and by providing additional sleeves on cap 41 to engage the stiles of the additional panels.

A fence panel constructed as described enables one to build a fence with a minimum of tools, hardware, and manpower. The fence almost snaps together and, when staked, is rigid and secure. There is no need for fence posts. As shown in FIG. 7 there are essentially only two different components to the fence, the fence panels themselves and the two stakes for each panel. One can assemble the fence by simply coupling the panels together and driving the stakes with a hammer. No other tool is required, except a plumb guide to make sure that the fence is vertical. A gate is simply a different panel. Disassembly is rapid, non-destructive, and leaves no posts set in concrete.

Having thus described the different embodiments of the invention it will be apparent to those of skill in the art that various modifications can be made within the spirit of the invention. For example, the material from which the fence is made is not critical and typically is steel or aluminum. The relative sizes of the components is also a matter of design depending upon the particular application for the fence. A lightweight fence would use pipe having an outside diameter of approximately one inch, while a heavier duty fence would use pipe having an outside diameter of one and one half inches or more. Although pipe is typically used for all the rails and stiles, only the lower rail need be hollow, at least on the ends, for receiving the coupling pin.

I claim:

1. A fence having a series of self-supporting, adjoining panels, each supporting a web, wherein each panel comprises:

an upper rail;

a lower rail;

a first stile having an upper end and having a lower end abutting on one end of the lower rail to form a first corner;

a second stile having an upper end and having a lower end abutting on the other end of the lower rail to form a second corner; wherein the ends of said lower rail are open;

said upper rail abutting on said first and second stiles at a point below the upper ends of said first and second stiles;

a first skewed anchor sleeve attached to said lower rail said at first corner; and a second skewed anchor sleeve attached to said lower rail at said second corner.

2. The fence as set forth in claim 1 wherein said first and second skewed anchor sleeves are on opposite sides of said lower rail.

3. The fence as set forth in claim 1 wherein said first skewed anchor sleeve is also attached to said first stile and said second skewed anchor sleeve is also attached to said second stile.

4. The fence as set forth in claim 1 wherein said lower rail is a pipe.

5. The fence as set forth in claim 4 and further comprising a plurality of pins, one pin connecting the respective open ends of the lower rails of said adjoining panels.

6. The fence as set forth in claim 5 wherein said pins are removable from the respective open ends of the lower rails of both said adjoining panels.

7. The fence as set forth in claim 5 wherein at least some of said pins are permanently attached in one of the open ends of the lower rails of said adjoining panels.

8. The fence as set forth in claim 1 and further comprising a plurality of caps, one each at the juncture of said adjoining panels for connecting respective said upper ends of stiles from said adjoining panels.

9. The fence as set forth in claim 8 wherein each of said caps comprises a pair of parallel sleeves attached to each other and fitting over the adjacent upper ends of said stiles from said adjoining panels.

10. The fence as set forth in claim 8 wherein each said panel has one of said caps permanently attached to said first stile and another of said caps removably connected to said second stile.

11. The fence as set forth in claim 1 and further comprising a plurality of stakes extending through respective ones of said skewed anchor sleeves for attaching each said panel to the ground.

12. The fence as set forth in claim 1 and further comprising a barrier attached between said upper ends of said first and second stiles of at least one said panel.

13. A self-supporting panel for a fence comprising:

an upper rail;

a lower rail;

a first stile having an upper end and having a lower end abutting on one end of the lower rail to form a first corner;

a second stile having an upper end and having a lower end abutting on the other end of the lower rail to form a second corner; wherein the ends of said lower rail are open;

said upper rail abutting on said first and second stiles at a point below the upper ends of said first and second stiles;

a first skewed anchor sleeve attached to said lower rail at said first corner; and a second skewed anchor sleeve attached to said lower rail at said second corner.

14. The panel as set forth in claim 13 wherein said first and second skewed anchor sleeves are on opposite sides of said lower rail.

15. The panel as set forth in claim 13 wherein said lower rail is a pipe.

16. The panel as set forth in claim 15 and further comprising a pin disposed in said one end of said lower rail.

17. The panel as set forth in claim 16 wherein said pin is permanently attached to said lower rail at said first corner.

18. The panel as set forth in claim 13 and further comprising a cap attached to said upper end of said first stile.

* * * * *